US006309130B1

(12) United States Patent
Johnson et al.

(10) Patent No.: US 6,309,130 B1
(45) Date of Patent: Oct. 30, 2001

(54) ORGANIZER STRIP SYSTEM, TOOL AND METHOD OF USE

(75) Inventors: Steven Philip Johnson; Bruce Shields Mason, both of Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/589,682

(22) Filed: Jun. 7, 2000

(51) Int. Cl.[7] ..... B42F 13/40

(52) U.S. Cl. ..... 402/4; 402/80 R; 281/15.1; 412/1

(58) Field of Search ..... 281/22, 15.1, 21.1, 281/28, 37; 402/1, 4, 80 R; 412/1, 9, 25, 28, 37, 901, 902; 156/247

(56) References Cited

U.S. PATENT DOCUMENTS

| | | | | |
|---|---|---|---|---|
| 3,987,694 | | 10/1976 | Kaufman | 83/453 |
| 4,070,223 | | 1/1978 | Stalzer | 156/264 |
| 4,523,776 | * | 6/1985 | Barber | 283/39 |
| 4,907,825 | | 3/1990 | Miles et al. | 281/51 |
| 5,326,066 | * | 7/1994 | Tischer | 248/451 |
| 5,407,512 | * | 4/1995 | Policht | 156/247 |
| 5,524,929 | | 6/1996 | Emmel et al. | 281/211 |

FOREIGN PATENT DOCUMENTS

| | | | |
|---|---|---|---|
| 395923 | 7/1965 | (CH) . | |
| 0 668 169 A1 | 8/1995 | (EP) | B42D/1/08 |
| WO 98/33627 | 8/1998 | (WO) | B25C/5/02 |

* cited by examiner

*Primary Examiner*—Willmon Fridie, Jr.
(74) *Attorney, Agent, or Firm*—Nestor F. Ho; Yen Tong Florczak

(57) ABSTRACT

An organizer system for attaching a document to a binder, the document having at least one edge. The system includes a strip including an elongated layer of material having a first major surface and an opposite second major surface, the first major surface having an inner edge portion and an outer edge portion, said outer edge portion defining a document attachment feature, said inner portion including a coating of adhesive. The system further includes a positioning tool having a strip positioning portion including strip alignment features and a document receiving portion having document alignment features corresponding to the at least one edge of the document. The strip positioning portion receives the inner edge portion of the strip and the outer edge portion of the strip overlaps the document edge alignment feature.

4 Claims, 7 Drawing Sheets

ORGANIZER STRIP SYSTEM, TOOL AND METHOD OF USE

BACKGROUND OF THE INVENTION

The present invention relates generally to an organizer system for attaching documents to binders or other file storage systems. More specifically, the present invention describes a positioning tool that allows for the attachment of strips that can be adhered to documents and have openings adapted to receive the fasteners in binders so that documents can be mounted in the binders without punching them.

Documents are often kept in binders such as ring binders, personal organizers, etc. Documents usually may be altered to fit into those binders by punching holes, or by placing other storage features along edge portions of the documents. However, for certain documents, such as illustrations, transparencies or important legal documents, it may not be desirable or aesthetic to punch holes or attach permanent storage features to the documents. Moreover, punching holes in a document causes permanent damage to the document and may remove information from the document. Punched documents are susceptible to tears around the holes. Reinforcing rings may reinforce damaged areas of documents around such holes, but application of such rings to every hole is time. consuming and may further cover information on the document.

Strips are known that can be adhered to documents and have openings adapted to receive the fasteners in binders so that documents can be mounted in the binders without punching them. U.S. Pat. No. 4,800,170 describes such a strip for which the "glue needs to be heated to secure page binder with spine section with a number of closely adjacent beads of hot melt glue". Other such strips are adhered by layers of pressure sensitive adhesive covered by liners that must be removed before the strips are used. For example, U.S. Pat. No. 5,248,164 describes a "binder with a stub edge, notable, for filing loose-leaf and intermediate sheets". This "binder" has "one or two vertical strips coated with a nonpermanent adhesive layer protected by a protective film". EP 0 266 454 B1 describes "a binder for connecting two sheet formed articles of paper or the like . . . [the] end portions being provided with an adhesive layer covered by sheet of release paper and application onto the respective article forming a strong adhesive bond therewith." Liner-free strips for attaching loose documents into a file folder or ting-binder are described in WO87/02941 (Cheng), in FR2 543 066, and in U.S. Pat. No. 4,715,759 that describes "a system of counterfoil binding, fit in particular to classify documents in the form of loose sheets" and states that the strip "can be either transparent or opaque."

Commonly owned U.S. Pat. No. 5,683,194, which is hereby incorporated by reference, discloses a novel organizer strip. The strip comprises (1) an elongate layer of thin flexible material having opposite major side surfaces, opposite ends, inner and outer opposite elongate edges between its ends, an inner edge portion along its inner edge, and an outer edge portion along its outer edge; and (2) a coating of repositionable pressure sensitive adhesive on one major surface along the inner edge portion, with the layer being free of adhesive on both of its side surfaces along its outer edge portion. The outer edge portion of the strip is visually distinctive, and the juncture between the inner and outer portions is visibly distinctive. The strip has at least one and typically a plurality of spaced opening through the outer edge portion of the layer that are adapted to receive portions of binders. Thus, a document to which the coating of adhesive along the inner edge portion is adhered with the edge of the document along the juncture between the inner and outer portions can be bound in a binder without punching the document by attaching the outer portion to the binder.

Traditionally, a user manually attaches the described organizer strip onto a document. As with any other manual procedure, the accuracy and repeatability of the attachment depends on the skill of the user. When organizer strips are attached to multiple sheets, alignment and positional differences tend to occur. Misaligned pages affect the professional appearance of the stored documents.

SUMMARY OF THE INVENTION

The present invention is directed to an organizer system and positioning tool to ensure repeatable positioning and alignment of organizer strips on multiple documents. The organizer system aids in attaching a document to a binder, the document having some predetermined dimensions and shape.

The system includes a strip and a positioning tool. The tool aids in aligning a document for attaching an adhesive organizer strip to the document in a desired position and alignment.

The strip includes an elongated layer of material having a first major surface and an opposite second major surface. The first major surface has an inner edge portion and an outer edge portion. The outer edge portion defines a document attachment feature. The inner portion includes a coating of adhesive.

The positioning tool includes a tray having interior document alignment means defining a desired document position and interior strip alignment means defining a desired position for the adhesive organizer strip with respect to the document.

The tray is a receiving tray having an outside border on the tray defining a document receiving recess that at least partly receives the document and a nested organizer strip receiving recess that partly receives the organizer strip. The organizer strip receiving recess has strip alignment features that place the organizer strip in a desired position. The document receiving recess has document alignment features that allow the user to align the document in a desired position with respect to the organizer strip, where at least a part of the adhesive portion overlaps the document.

In one embodiment, the document alignment means includes raised borders along three edges of the tray, the raised borders defining a slot having an open end, and interior indentation features within the slot defining a stop against which to abut the document.

The positioning tool has a strip positioning portion including strip alignment features and a document receiving potion having document alignment features corresponding to the predetermined dimensions and shape of the document. In one embodiment, the positioning tool comprises a tray having an outside border defining a recess including the strip positioning portion and the document receiving portion. Also, the document attachment feature comprises at least one through opening and the strip alignment features include at least one locator pin matching the desired position of the at least one through opening.

The strip positioning portion receives the inner edge portion of the strip and the outer edge portion of the strip overlaps the document edge alignment feature. The depth of the strip positioning portion may be sized to retain and package a plurality of the strips arranged in a pad.

The document alignment features include at least one lip against which the document abuts when in the document receiving portion and side rails aligning the document within the recess.

For certain embodiments where the document comprises a traditional rectangular sheet having a longitudinal straight edge having a first longitudinal dimension, the strip comprises a rectangular elongated layer of material having a second longitudinal dimension smaller than the first longitudinal dimension. The strip positioning portion comprises a first U-shaped rectangular recess having a generally flat bottom, a longitudinal rail, an opposite open end, and two side rails spaced a distance generally the same or slightly larger than the second longitudinal dimension. The document receiving portion comprises a second U-shaped rectangular recess adjacent the open end of the first recess. The second recess has two side rails spaced a distance generally the same or slightly larger than the first longitudinal dimension and a first longitudinal side including the open end of the first recess. The difference in the longitudinal dimensions of the first and second recesses define a first and a second lip features.

The positioning tool may be manufactured as a thermoformed plastic tray, or may be injected, molded, cut, carved or manufactured by other suitable methods using a variety of materials, such as plastics, metal, and paper products.

The present invention also includes a method for applying an organizer strip having an adhesive edge to a document. The method comprises the step of providing organizer tool as described. The document is placed onto the tray until the document meets the document alignment features. In embodiments where a tool having a single open end is used, the step of placing the document onto the tray may include sliding the document through the open end of the slot. The user then adheres the organizer strip onto the document using the strip alignment features to guide the position of the strip.

In one embodiment of the method, the organizer strip is placed on the tray before placing the document on the tray. The strip is placed with the adhesive facing up, and the document is aligned over the adhesive strip. This particular embodiment may be particularly useful in combination with a tool having a retractable or spring loaded strip receiving recess. Such tool may be sized to accommodate an entire pad of strips.

In another embodiment, the document is placed first on the document receiving recess and the strip is then placed over the document. Where the organizer strip includes at least one hole at a predetermined position, the strip alignment features may include at least one positioning pin matching the at least one hole. The step of placing the organizer strip in the tray may then comprise aligning the at least one positioning pin with the at least one hole in the organizer strip and placing the adhesive edge face down on the document. For strips including pressure sensitive adhesive, the user may then apply pressure to secure the adhesive edge onto the sheet.

DETAILED DESCRIPTION OF THE INVENTION

Figure 1:
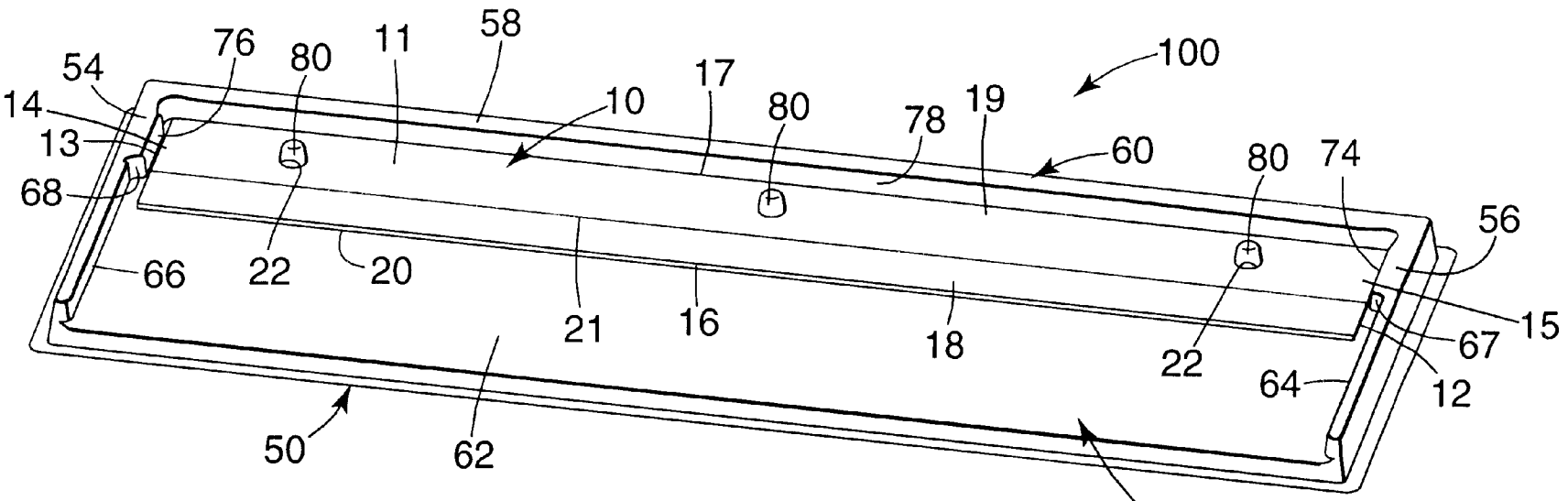
FIG. 1 is a perspective view of an organizer system in accordance with the present invention.
Figure 2:
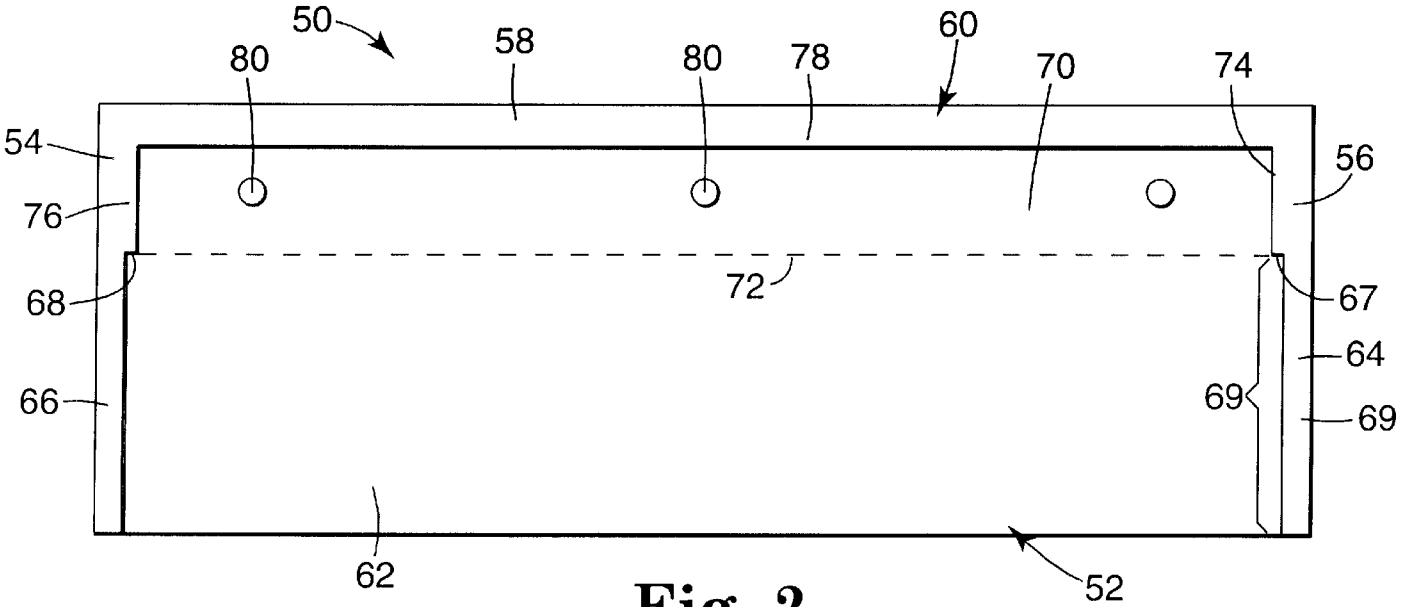
FIG. 2 is a plan view of the positioning tool of the organizer system illustrated in FIG. 1.
Figure 3:
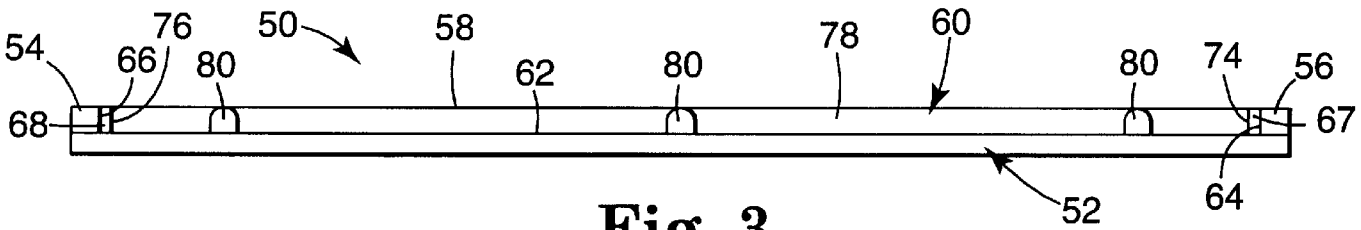
FIG. 3 is a front elevation view of the positioning tool of the organizer system illustrated in FIG. 1.
Figure 4:
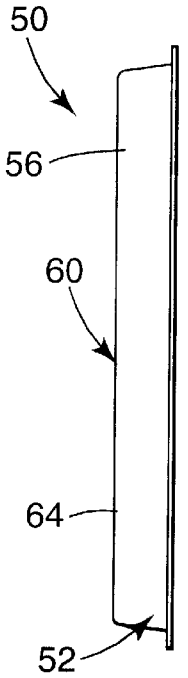
FIG. 4 is a side elevation view of the positioning tool of the organizer system illustrated in FIG. 1.
Figure 5:
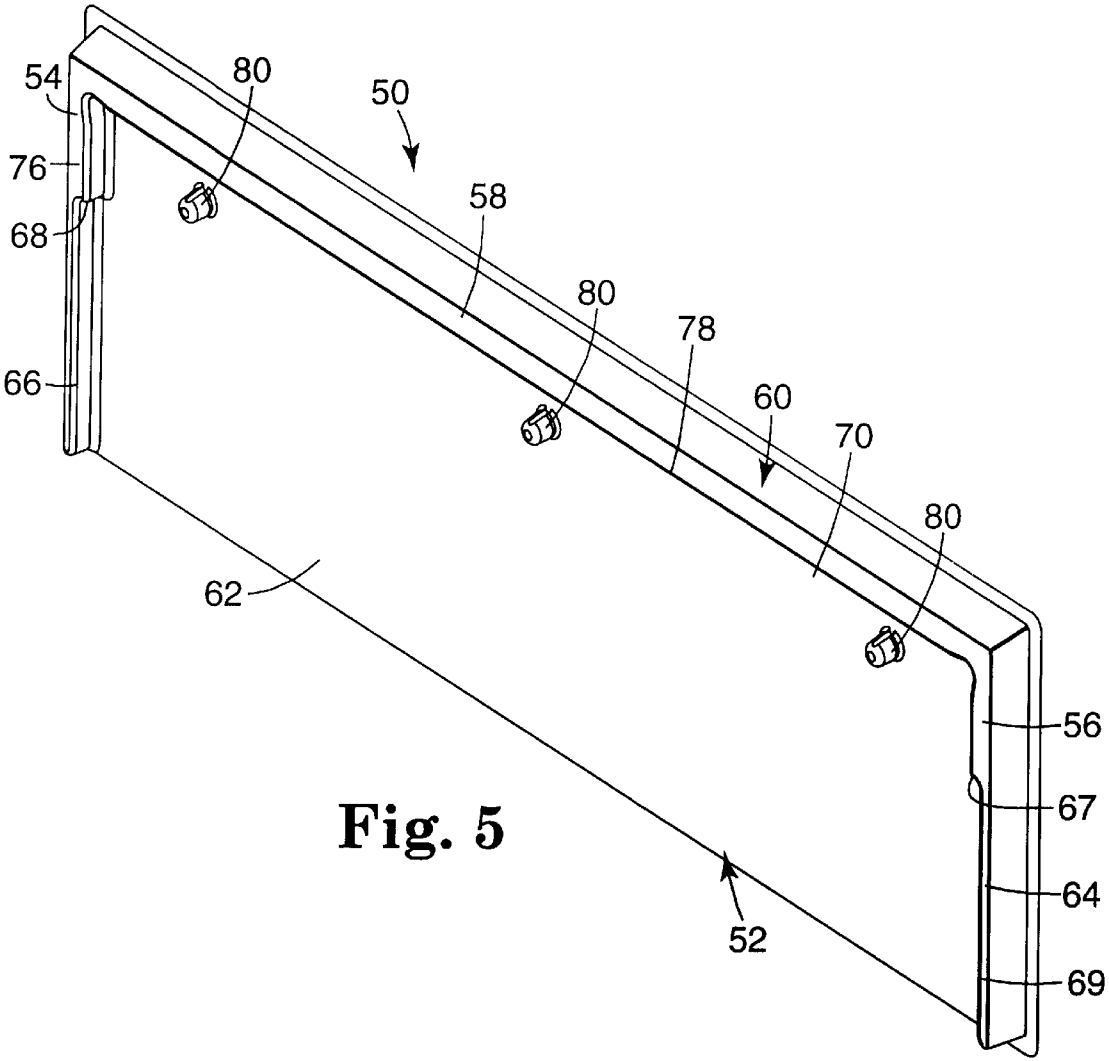
FIG. 5 is a perspective view of the positioning tool of the organizer system illustrated in FIG. 1.
Figure 6A:
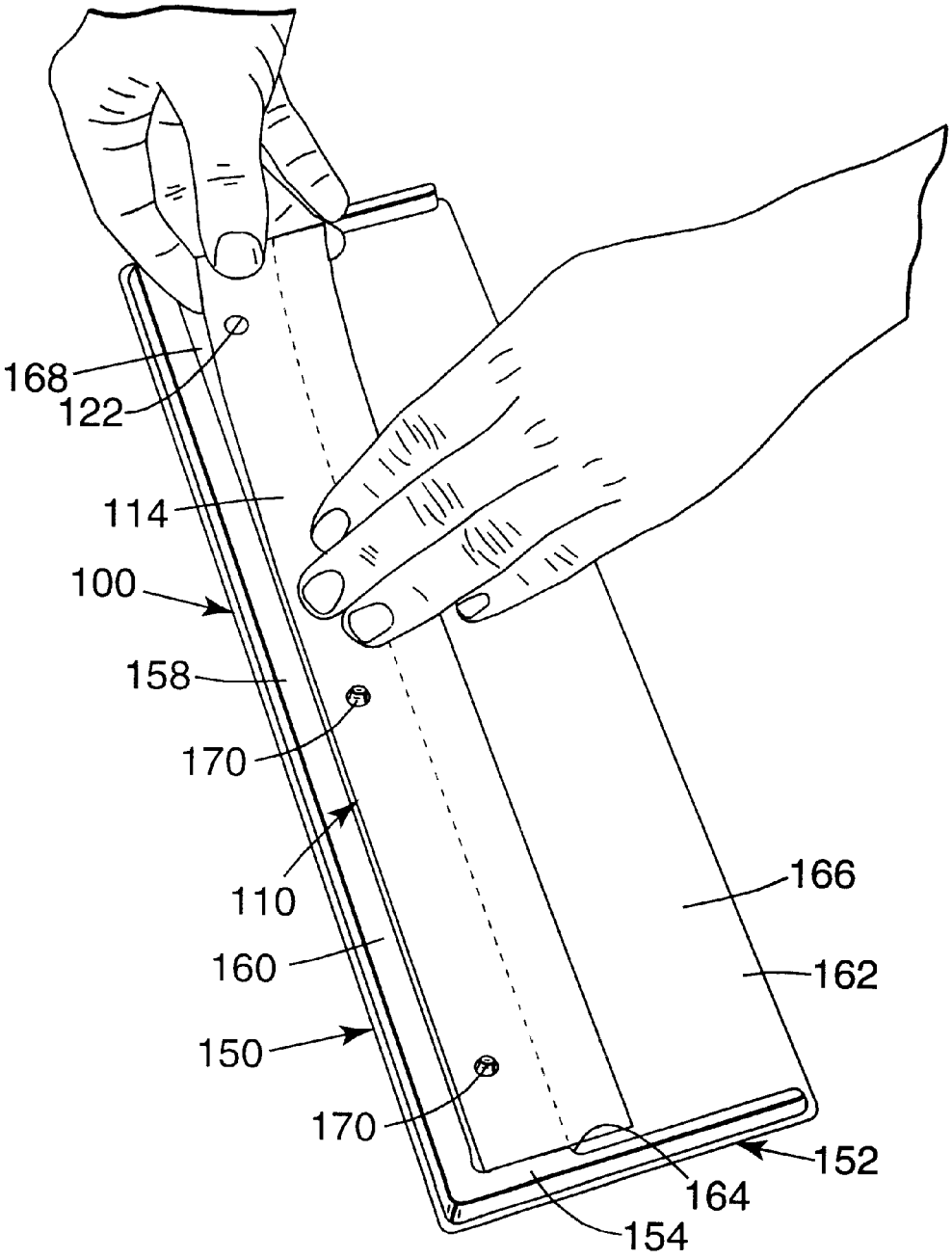
FIGS. 6*a*–6*d* illustrate steps in the method of applying the organizer strip in accordance with the present invention.
Figure 6B:
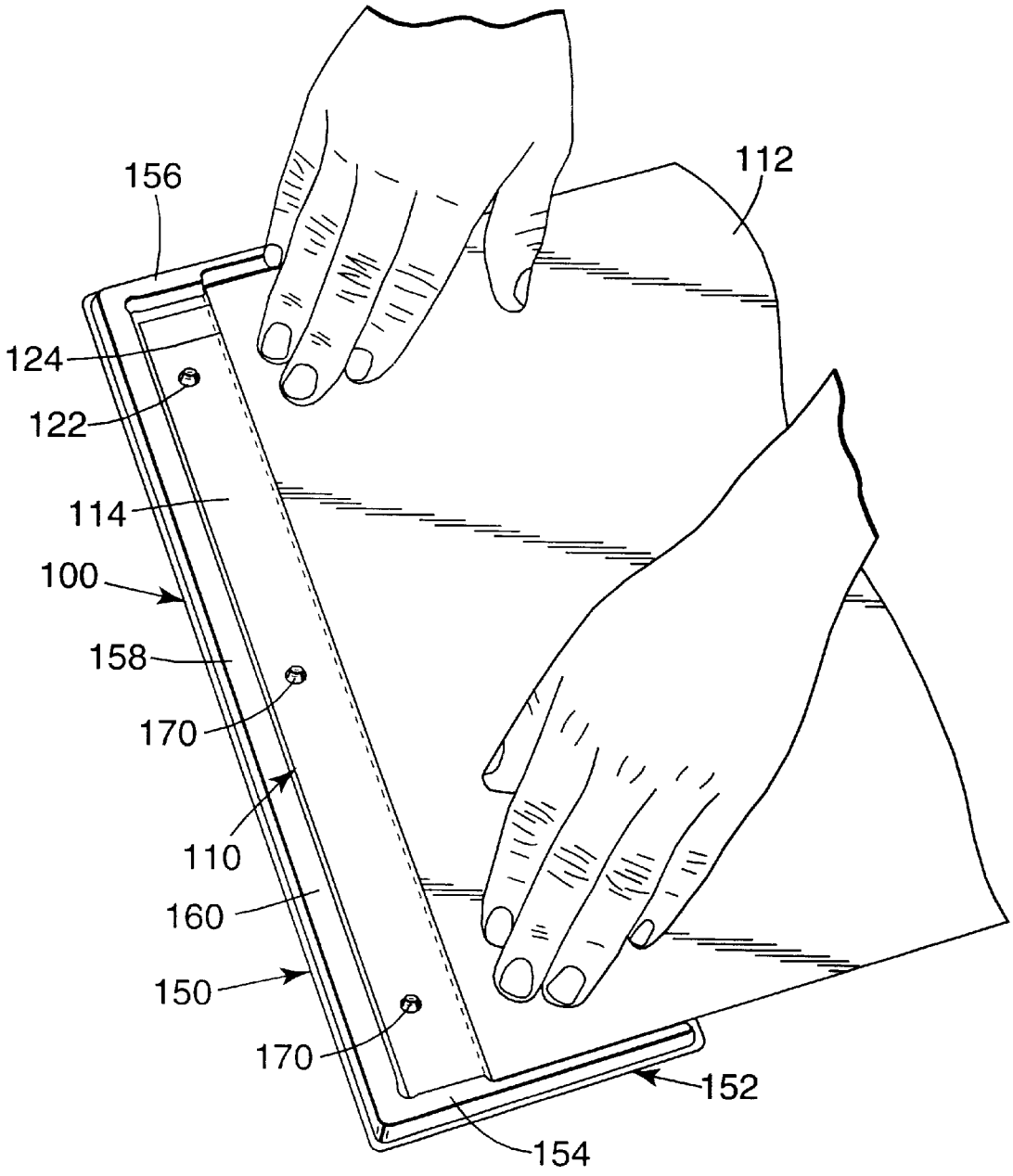
Figure 6C:
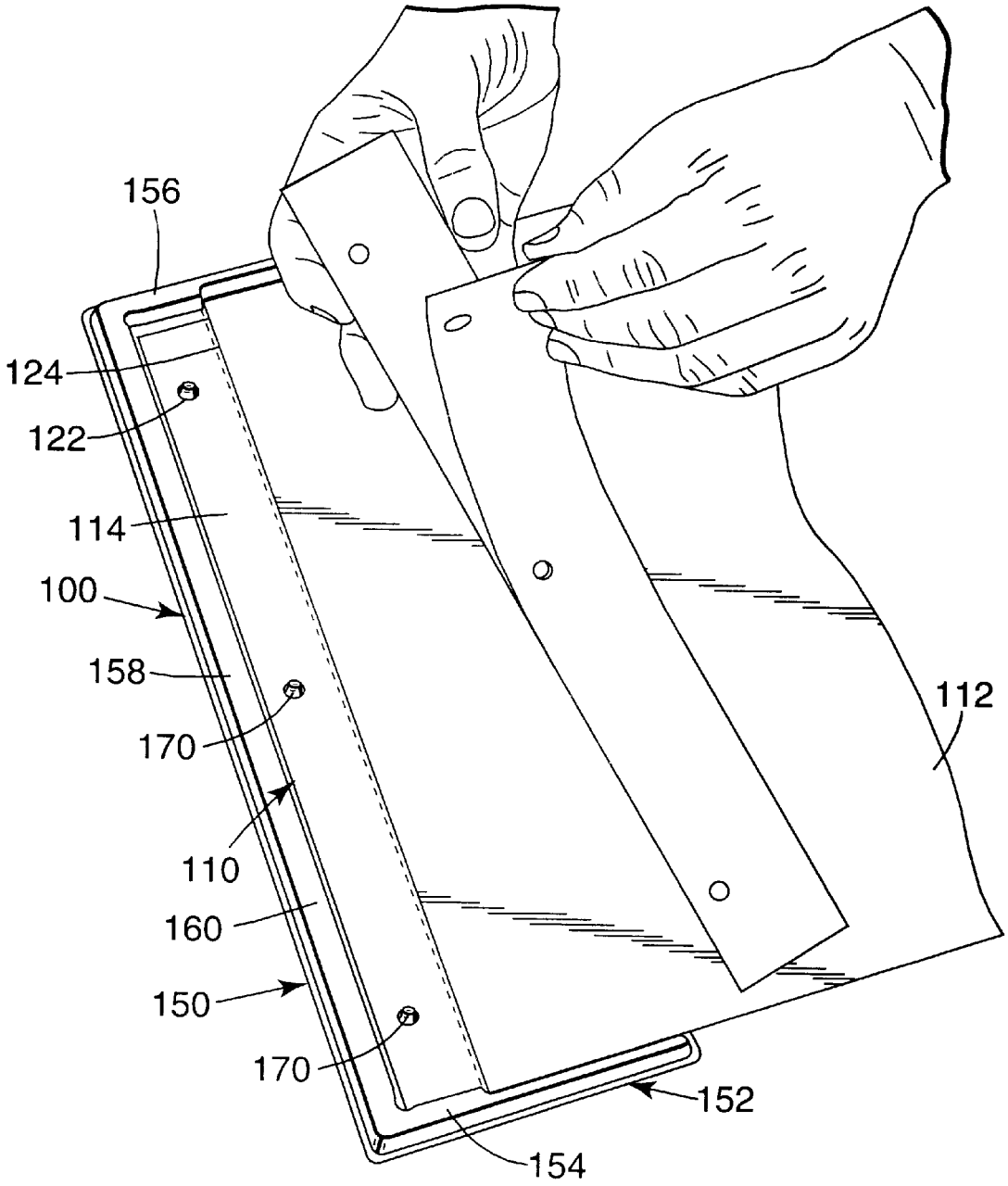
Figure 6D:
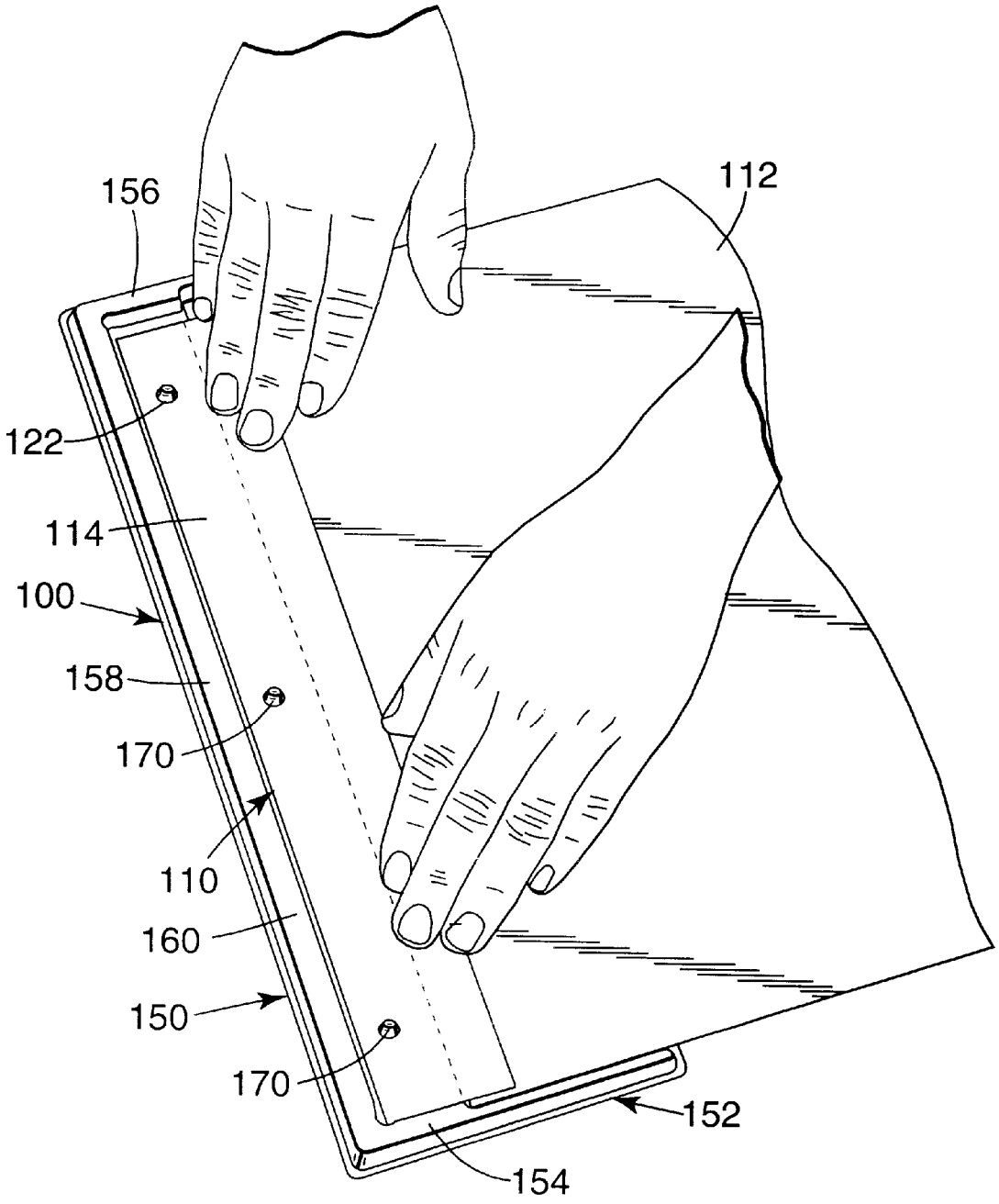

FIG. 1 illustrates an organizer system 100 in accordance with the present invention. The organizer system 100 includes an organizer strip 10 and a positioning tool 50.

The strip 10 may be used for attaching a document to a binder without punching openings in the document or, alternatively, for reinforcing a document around openings formed in the document through which the document can be mounted in a binder. The term document is meant to include paper sheets, transparencies, fabrics, photographs, booklets, maps or any other material that may be stored in a binder or file and arranged and stacked.

The strip 10 comprises an elongate layer 11 of thin flexible material (e.g., polymeric film, such as cellulose acetate, or polypropylene. In the present embodiment, the layer 11 is 0.0056 centimeter or 0.0022 inch thick polyester. Other embodiments include polyester material from 0.0038 to 0.0076 centimeter thick. The layer 11 has opposite major side surfaces 12 and 13, opposite ends 14 and 15, inner and outer opposite elongate edges 16 and 17, an inner edge portion 18 along its inner edge 16, and an outer edge portion 19 along its outer edge 17. The strip 10 includes a coating 20 of repositionable pressure sensitive adhesive (e.g., the pressure sensitive adhesive described in U.S. Pat. Nos. 3,691,140 and 4,166,152 incorporated herein by reference) on its one major surface 13 along the inner edge portion 18 of the layer 11. The layer 11 is free of adhesive on both of the side surfaces 12 and 13 along the outer edge portion 19 of the layer 11. The outer edge portion 19 is visually distinctive (e.g., coated with brightly colored ink such as red, green, or yellow ink); and the juncture 21 between the inner and outer edge portions 18 and 19 is straight and visibly distinctive.

In the illustrated embodiment, the strip 10 has at least one, and as illustrated, a plurality of spaced openings 22 through its outer edge portion 19. The openings 22 are perforated holes made using mechanical or laser perforating means. The openings 22 act as document attachment features and are sized and positioned to receive binder rings. A document (not illustrated) to which the coating 20 of adhesive along the inner edge portion 18 is adhered with the edge of the document along the juncture 21 between the inner and outer portions 18 and 19 may then be stored in a binder without punching the document. Alternatively, a punched document having openings through which the document is bound in a binder may be reinforced by adhering the coating 20 of adhesive to the document with the openings 22 in the outer edge portion 19 in alignment with the openings in the document.

The openings 22 may be made many shapes (e.g., holes, slots, or slits) and may be shaped and spaced to match any required configuration (e.g., for a standard three-ring binder, for personal organizers, for file folders, for wound wire binders, for prong fasteners, for report covers, or the like). In alternative embodiments, other document attachment features may be used that match the desired type of binder. For example, the outer edge portion 19 may be oversized to accommodate pressure clamps, include friction coatings to accommodate friction binders, may include desired adhesives for binding, or may include spiral binding coils.

The edge portions of the layer 11 are adapted to be written on by using most standard writing implements. A person may record information on the removable strip without defacing the document mounted by the strip. If desired, the strip 10 also may be custom printed, for example, by using flexographic printing.

The adhesive coated inner edge portion 18 may be generally transparent when adhered to a substrate if the layer 11 is of polymeric film. The major surface 13 of the layer 11 may be coated with a layer of release coating that may be written or printed on and/or a layer of low adhesion backside (not shown) that allows a plurality of the strips 10 to be adhered together in a stack without the need for a liner between the strips 10. A single liner or back sheet (not shown) may be used to protect the coating 20 of adhesive on the bottom strip 10 in the stack.

The strip 10 may be made in any length. In the present embodiment, the strip 10 is slightly shorter in length than the document to which the strip 10 is intended to be attached.

The inner and outer edge portions 18 and 19 may be of any desired width. The present embodiment has a width for the outer edge portion 19 between about 0.50 to 0.75 inch (approximately 1.25 to 1.9 cms.) wide, and a width for the inner edge portion 18 between about 0.75 to 1.25 inches (approximately 1.9 to 3.2 cms.) wide.

Additional details regarding the organizer strip may be found in commonly assigned U.S. Pat. No. 5,683,194, which is hereby incorporated by reference.

Details for the tool 50 may be better appreciated in FIGS. 2–5. Dimensions are given in inches. In the present embodiment, the tool 50 is a thermoformed plastic, guch as PVC, PET, or polystyrene, tray used as the primary display packaging and application tool for the 3M Organizer strip product. The tool 50 serves both as the retail display package and the assembler tool for the 3M-organizer strip product. The present embodiment is clear, although colors and designs may be added. Pads of the organizer strip 10 will be positioned on the tool 50 and shrink-wrapped, packaged, shipped and displayed inside the tool. The tool 50 protects the organizer strip 10 through all channels of shipping and distribution. The tool tray is designed to fit the retail display area of all office supply superstores.

In alternative embodiments, the tool 50 may be made of other materials, such as paperboard, corrugated board, metals, alloys, wood or other plastics (such as thermal set plastics). The tool 50 may be manufactured using multiple processes including but not limited to thermoforming, injection molding, pressure forming, casting, and pulp forming.

The tool 50 includes a generally flat rectangular tray 52. Opposite side raised borders 54 and 56 and a longitudinal border 58 define a C-shaped slot 60 shaped to match the geometry of the strip 10 and of the document to be inserted. The slot 60 includes a first outer document receiving recess 62 and a nested inner strip receiving recess 70.

Both receiving recesses 62 and 70 include internal guidance geometry to locate the document and the strip 10 accurately and repeatably. The document receiving recess 62 includes two side rails 64 and 66 separated a distance nearly the same or only slightly larger (11.062 inches) than the width of the side of the document to which the organizer strip is to be attached (11 inches). The distance between the rails 64 and 66 is selected to provide guidance to the document and to align the edges of the document. In alternative embodiments, the rails 64 and 66 may be mechanically adjustable.

The document receiving recess 62 further includes two lip indentations 67 and 68 that provide a stop against which to align the document. The present embodiment also may include a longitudinally extending step or indentation 69 separating the document recess 62 from the strip receiving recess 70.

While in the present embodiment the document receiving recess 62 has an open side, the present invention contemplates embodiments in which borders outline the entire periphery of the desired position for the document.

The strip receiving recess 70 includes an open end 72 adjacent to the document receiving recess 62. The strip receiving recess 70 further includes two opposite side rails 74 and 76 and a longitudinal rail 78. Again, the distance between the side rails 74 and 76 is selected to be approximately the same or slightly larger than the length of the strip 10. However, side rail alignment is not as crucial as in the document receiving cavity 62, as the strip receiving cavity 70 further includes locating or alignment pins 80 that correspond to the apertures 22 of the strip 10.

In the present embodiment, the depth of the strip receiving recess 70 is sufficient to hold an entire pad of organizer strips, thus allowing the tool 50 to package and display the organizer strips 10. The width of the strip receiving recess is selected to accommodate the inner edge portion 18 of the strip 10, while allowing at least a part of the outer edge portion 19 to overlap into the document receiving recess 62. In alternative embodiments, the strip receiving recess 70 may be shallower and may lack side rails or other peripheral geometrical alignment features, relying only on the alignment provided by pins 80. In yet other alternative embodiments, the strip receiving recess may include a deeper retaining well, sized to hold a pad of organizer strips placed with the adhesive coating 20 facing upwards. Such embodiments also may include mechanical means to retract the strips while the document is being placed on the tool and for exerting pressure on the adhesive portion once the document is positioned to receive the organizer strip.

This device serves a need to accurately position the organizer strip onto whatever product it is applied. The device allows the user to correctly position the strip on the product, top to bottom and left to right to provide a professional appearance to the finished assembly. This is a time saving device designed to improve productivity in the application of 3M Organizer strips.

FIGS. 6*a*–6*d* illustrate a method for applying an organizer strip 110 having at least one perforated hole 122 and an adhesive edge 124 to a document sheet 112. In the commercial embodiment illustrated in FIG. 6*a,* organizer strips 110 are placed in a pad 114, which is packaged inside a tool 150.

The tool 150 includes a generally rectangular tray 152 and raised borders 154, 156 and 158 along three edges of the tray. The raised borders define a slot 160 having an open end 162. Interior indentation features 164 within the slot define a document area 166 and an organizer strip area 168. At least one positioning/alignment pin 170 within the organizer strip area 168 matches the at least one perforated hole 122 on the strips 110.

The pad 114 is aligned and retained by the alignment pins 170. First, the organizer strip pad 114 is removed from the tool 150. The document 112 is slid into the tool 150 through the open end 162 until the document 112 meets the indentation features 164 on the tray 152.

The user then peels off one organizer strip 110 and places the strip 110 onto the tool 150, such that over document) so that the pins 170 in the tool 150 line up with the holes 122 in the organizer strip 110. The adhesive edge 124 of the organizer strip 110 is placed facing down onto the edge of the document 112.

Alternatively, the user may place the organizer strip 110, alone or in the pad, with the adhesive edge 124 facing outward and the pins 170 aligned with the holes 122, before placing the document 112 onto the tool 150. This method is especially desirable in embodiments of the tool 150 having a retractable or spring-loaded organizer strip area 168 that may allow the user to avoid contact between the adhesive edge 124 and the document 112 until the document 112 is aligned correctly within the tool 150.

In embodiments where the adhesive edge is pressure sensitive, the user presses the organizer strip 110 down firmly onto the document 112. The now tabbed document is removed from the tool 150 and the organizer strip pad 114 is stored on the organizer strip area 168 after use.

Those skilled in the art will appreciate that the present invention may be used when coupling a variety of optical devices and even non-optical devices that require precise alignment. While the present invention has been described with a reference to exemplary preferred embodiments, the invention may be embodied in other specific forms without departing from the spirit of the invention. Accordingly, it should be understood that the embodiments described and illustrated herein are only exemplary and should not be considered as limiting the scope of the present invention. Other variations and modifications may be made in accordance with the spirit and scope of the present invention.

What is claimed is:

1. An organizer system for attaching a document to a binder, the document having at least one edge, the system comprising:

a) a strip including
  i) an elongated layer of material having a first major surface and an opposite second major surface,
  ii) the first major surface having an inner edge portion and an outer edge portion, said outer edge portion defining a document wherein the document attachment feature comprises at least one through opening; and b) a positioning tool having
  i) a strip positioning portion including strip alignment features further including at least one locator pin matching the desired position of the at least one through opening
  ii) a document receiving portion having document alignment features corresponding to the at least one edge of the document,
  iii) wherein the strip positioning portion receives the inner edge portion of the strip and the outer edge portion of the strip overlaps the document edge alignment feature.

2. An organizer system for attaching a document to a binder, the document having at least one edge, the system comprising:

a) a strip including
  i) an elongated layer of material having a first major surface and an opposite second major surface,
  ii) the first major surface having an inner edge portion and an outer edge portion, said outer edge portion defining a document attachment feature, said inner portion including a coating of adhesive;

b) a positioning tool having
  i) a strip positioning portion including strip alignment features,
  ii) a document receiving portion having document alignment features corresponding to the at least one edge of the document,
  iii) wherein the strip positioning portion receives the inner edge portion of the strip and the outer edge portion of the strip overlaps the document edge alignment feature;

c) wherein the document comprises a rectangular sheet having a longitudinal straight edge having a first longitudinal dimension, the strip comprising a rectangular elongated layer of material having a second longitudinal dimension smaller than the first longitudinal dimension;

d) wherein the strip positioning portion comprises a first U-shaped rectangular recess having a generally flat bottom, a longitudinal rail, an opposite open end, and two side rails spaced a distance generally the same or slightly larger than the second longitudinal dimension; and e) wherein the document receiving portion comprises a second U-shaped rectangular recess adjacent the open end of the first recess, the second recess having two side rails spaced a distance generally the same or slightly larger than the first longitudinal dimension and a first longitudinal side including the open end of the first recess, the difference in the longitudinal dimensions of the first and second recesses defining a first and a second lip features.

3. A method for applying an organizer strip having an adhesive edge to a document, the method comprising the steps of:

a) providing an organizer tool comprising
  i) a strip including an elongated layer of material having a first major surface and an opposite second major surface,
  ii) the first major surface having an inner edge portion and an outer edge portion, said outer edge portion defining a document attachment feature, said inner portion including a coating of adhesive;

b) providing a positioning tool having
  i) a strip positioning portion including strip alignment features,
  ii) a document receiving portion having document alignment features corresponding to the at least one edge of the document,
  iii) wherein the strip positioning portion receives the inner edge portion of the strip and the outer edge portion of the strip overlaps the document edge alignment feature, c) placing the document onto the document receiving portion until the document meets the document alignment features and is disposed in a desired document position; and d) adhering the strip guided by the strip alignment features onto the document;

e) wherein the organizer strip includes at least one hole at a predetermined position, and strip alignment features include at least one positioning pin matching the at least one hole, adhering the strip comprising aligning the at least one positioning pin with the at least one hole in the organizer strip and placing the adhesive edge face down on the document.

4. A method for applying an organizer strip having an adhesive edge to a document, the method comprising the steps of:

a) providing an organizer tool comprising
  i) a tray,
  ii) interior document alignment features defining a desired document position within the tray, and iii) interior strip alignment features defining a desired position for the organizer strip with respect to the desired document position;

b) placing the document onto the tray until the document meet the document alignment features and is disposed in the desired document position; and c) adhering the organizer strip guided by the strip alignment feature onto the document, wherein the organizer strip includes at least one hole at a predetermined position and the strip alignment features including at least one positioning pin matching the at least one hole, the step of placing the organizer strip in the tray comprising aligning the at least one positioning pin with the at least one hole in the organizer strip and placing the adhesive edge face down on the document.

* * * * *

UNITED STATES PATENT AND TRADEMARK OFFICE

CERTIFICATE OF CORRECTION

PATENT NO. : 6,309,130 B1 
DATED : October 30, 2001
INVENTOR(S) : Stephen Philip Johnson and Bruce Shields Mason It is certified that error appears in the above-identified patent and that said Letters Patent is hereby corrected as shown below:

Column 2,
Line 53, “potion” should read -- portion --

Column 5,
Line 31, “quick” should read -- such --

Column 9,
Line 5, “meet” should read -- meets --
Line 8, “feature” should read -- features --

Signed and Sealed this

Thirty-first Day of December, 2002

JAMES E. ROGAN
*Director of the United States Patent and Trademark Office*